United States Patent [19]

Le Day

[11] 4,034,813

[45] July 12, 1977

[54] COMBINED FIRE EXTINGUISHER AND AUDIBLE ALARM

[76] Inventor: Norman C. Le Day, 11722 Palmwood Drive, Garden Grove, Calif. 92640

[21] Appl. No.: 619,447

[22] Filed: Oct. 3, 1975

[51] Int. Cl.[2] ..... A62C 3/00; A62C 37/24; G08B 17/04

[52] U.S. Cl. ..... 169/26; 169/51; 169/57; 169/74; 169/37; 116/112

[58] Field of Search ..... 169/26, 37, 42, 74, 169/89, 57, 51; 116/106, 112, 137 R; 137/557

[56] References Cited

U.S. PATENT DOCUMENTS

| | | | |
|---|---|---|---|
| 2,961,040 | 11/1960 | Wolters | 169/37 X |
| 3,520,368 | 7/1970 | Hayes | 116/106 X |
| 3,530,817 | 9/1970 | Garvey | 169/42 X |
| 3,536,139 | 10/1970 | Berti et al. | 169/26 |
| 3,572,443 | 3/1971 | Guise et al. | 169/74 X |
| 3,741,310 | 6/1973 | Hansen | 169/89 |

*Primary Examiner*—Evon C. Blunk
*Assistant Examiner*—Andres Kashnikow
*Attorney, Agent, or Firm*—Harold C. Horwitz

[57] ABSTRACT

A portable combined fire extinguisher and audible alarm that may be removably disposed at a desired location to automatically eject a stream of pressurized fire extinguishing fluid into an adjacent area upon the temperature of the ambient atmosphere surrounding the invention rising above a predetermined maximum. The invention is particularly useful in protecting areas in which highly combustible materials such as oily waste rags and the like are stored. The invention, when removably supported at a desired location, is adjustable horizontally through substantially 180°, and a discharge nozzle of the invention is capable of being disposed at any desired vertical angle relative to the area to be protected.

4 Claims, 6 Drawing Figures

FIG. 1
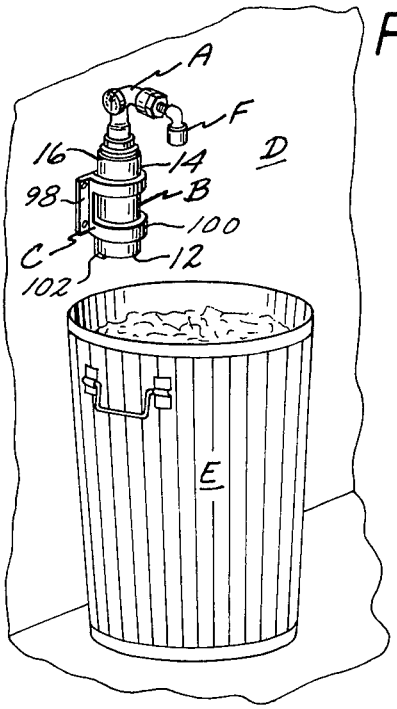
FIG. 2
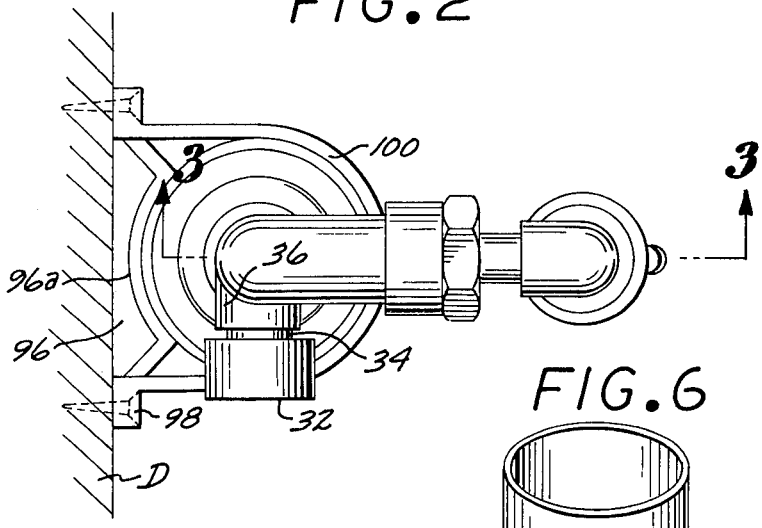
FIG. 6
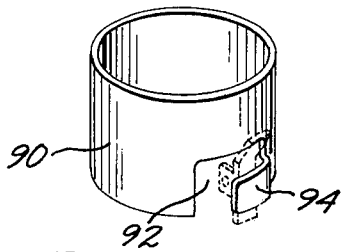
FIG. 3
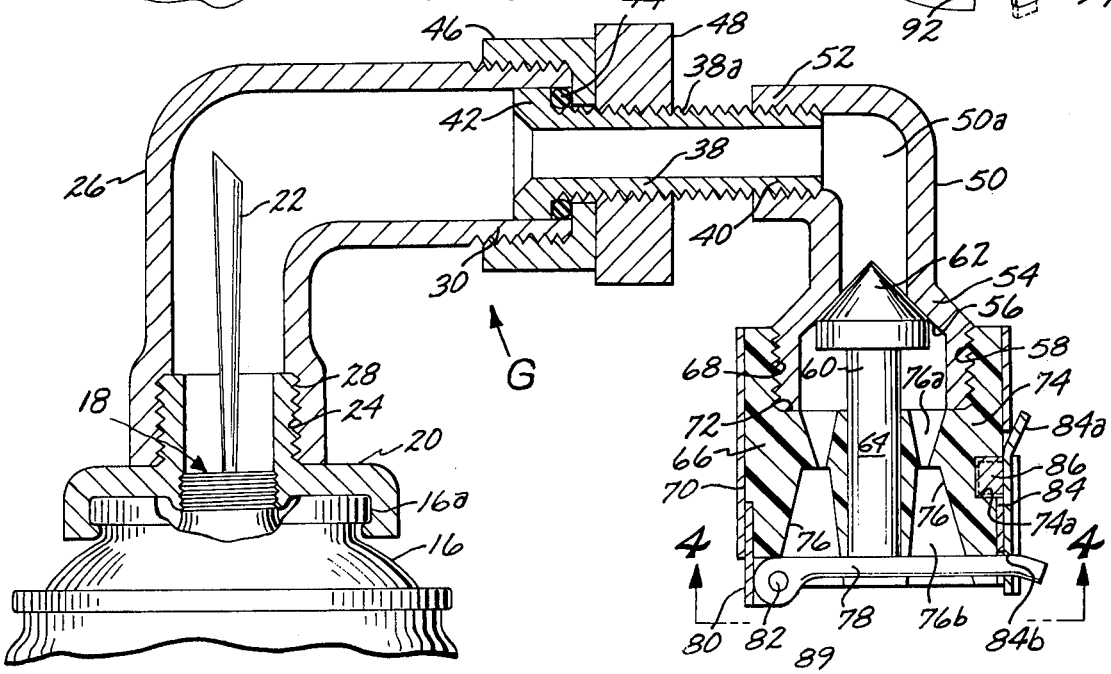
FIG. 4
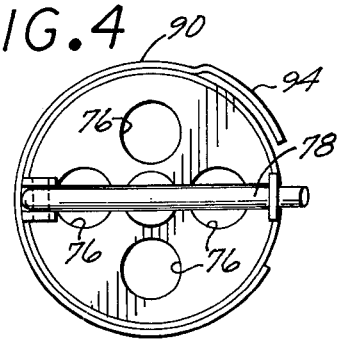
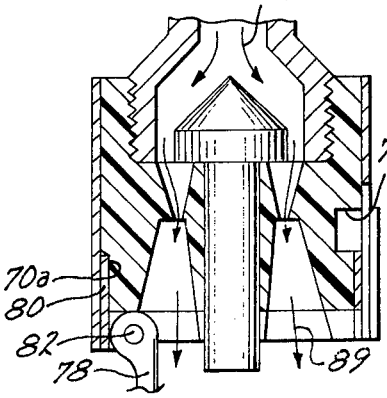
FIG. 5

COMBINED FIRE EXTINGUISHER AND AUDIBLE ALARM

BACKGROUND OF THE INVENTION

1. Field of the Invention

Combined Fire Extinguisher and Audible Alarm.

2. Description of the Prior Art

Highly combustible materials such as cleaning rags, oil soaked waste and the like are commonly stored in open receptacles in industrial plants until permanent disposition is made of such materials. Such receptacles are a prime source of fire that may arise from spontaneous combustion of the stored inflammable material or carelessness of an employee in discarding a lighted cigarette or match into the receptacle.

A major object of the present invention is to supply a combined fire extinguisher and audible alarm that may be mounted adjacent an inflammable waste containing receptacle, and the device being automatically actuated to sound an audible alarm and direct a spray of fire extinguishing fluid into the receptacle upon a temperature of the ambient atmosphere adjacent the device rising above a predetermined maximum value.

Another object of the invention is to provide a combined fire extinguisher and audible alarm that is portable, has a simple mechanical structure, can be fabricated from standard commercially available materials, and sold at a sufficiently low price as to encourage the widespread use thereof for its intended purpose.

SUMMARY OF THE INVENTION

A combined heat actuatable fire extinguisher and audible alarm capable of being wall supported by a bracket adjacent an area in which a fire may originate. The bracket adjustably supports a cylindrical container that holds a pressurized fire extinguishing fluid. The upper end of the container has a tubular assembly extending therefrom, which assembly adjustably supports a normally closed, heat sensitive nozzle on the free end thereof.

The nozzle is of such design that when pressurized fluid discharges therethrough at high velocity, a shrill audible sound is generated that serves as an alarm. The nozzle includes a pivotally supported pin that holds a movable valve member in a sealing position. When a fire originates adjacent the invention, a plug of wax or low melting point alloy softens and releases a trigger that is secured to the previously mentioned pin. The valve member now moves to an open position to permit the pressurized fire extinguishing fluid to a discharge through a number of tapered apertures defined in the nozzle and be directed as a spray onto the fire. As the pressurized fluid so discharges, a shrill noise is emitted from the nozzle that serves as an alarm that a fire has started. Although the fire in most instances will automatically be extinguished by the invention, the invention after extinguishing the fire must have a fresh cylinder of pressurized fire extinguishing fluid connected thereto.

The invention after having a second cylinder of pressurized fire extinguishing fluid attached thereto and the cylinder mounted in a wall supported bracket is thereafter capable of protecting the area adjacent thereto against fires in the manner previously described.

BRIEF DESCRIPTION OF THE DRAWING

FIG. 1 is a perspective view of the combined fire extinguisher and audible alarm adjustably supported from a wall by a bracket, and the extinguisher being located above a receptacle in which a fire may originate;

FIG. 2 is a top plan view of the device;

FIG. 3 is a longitudinal cross sectional view of the device taken on the line 3—3 of FIG. 2;

FIG. 4 is a bottom plan view of the nozzle taken on the line 4—4 of FIG. 3;

FIG. 5 is the same view of the nozzle as shown in FIG. 3, but with the valve member having moved to a second position to permit pressurized fire extinguishing fluid to flow through the nozzle and discharge therefrom as a spray; and FIG. 6 is a perspective view of a safety shipping ring that may be mounted on the nozzle to prevent inadvertent release of the trigger that holds the valve member supporting pin in a valve member closing position.

DESCRIPTION OF THE PREFERRED EMBODIMENT

The combined heat actuated fire extinguisher and audible alarm A, as may be seen in FIGS. 1 and 3, includes a cylindrical container B in which a pressurized fire extinguishing fluid (not shown) is contained. The container B is adjustably supported for swinging movement in a horizontal direction by a bracket C that is supported from a wall D, and the invention preferably being located above a receptacle E in which highly combustible material (not shown) is contained. The upper end of the cylindrical container B has a tubular assembly G extending outwardly therefrom, which assembly on the free end thereof supports a heat sensitive, normally closed nozzle F, which nozzle emits an audible sound when the invention is actuated. The method by which the heat sensitive, normally closed nozzle is placed in an open position due to a fire originating in the receptacle E will later be described in detail.

The cylindrical container B which is preferably a cold cup, extruded can includes a bottom 12, cylindrical side wall 14, top 16, and the top including a circumferentially extending lip **16*a*. The top 16 further includes a conventional normally closed valve 18 such as is commonly used at present on containers in which presurrized fluids are stored. The lip 16*a* is engaged by a conventional collar 20** formed from a resilient material, the collar being of a type manufactured by the Schrader Company.

The collar 20 supports an internally disposed tapered tube 22, with the collar when in place on the container B as shown in FIG. 3 so disposing the tube that the lower end thereof extends into an opening in the valve 18 to maintain the valve in an open position. The collar 20 has threads 24 formed on the upper external portion thereof as may be seen in FIG. 3, which threads are engaged by an internally threaded first end 28 of a first right angle tube 26. The first right angle tube 26 has an externally threaded second end 30. Intermediate the ends of the right angle tube 26 is an outwardly extending tubular boss 36 that engages a first tube 34 that is connected to a pressure gauge 32.

A rotatable tube 38 is provided that has an externally threaded first end portion 40 and a second shouldered end portion 42. The shouldered second end portion 42 has an O-ring mounted thereon. The externally threaded second end portion 42 as can best be seen in FIG. 3, is engaged by an O-ring housing nut 46, and a lock nut 48 engaging the threads 38*a* on rotatable tube 38. When the lock nut 48 is tightened, the shouldered second end 42 and housing nut 46 compress the O-ring 44 therebetween, and forces the O-ring into sealing engagement with the interior surface of the right angled tubes 26.

A second right angle tube 50 is provided as may be seen in FIG. 3 that has an internally threaded first end 52 and an enlarged second end portion 54. The enlarged second end portion 54 has a tapered valve seat 56 defined in the interior thereof that is in communication with a bore 50*a* formed within the second right angle tube 50. Threads 58 are formed on the external surface of the enlarged second end portion 54 as shown in FIG. 3. A valve member 60 is provided that has a tapered valve head 62 from which an elongate stem 64 extends.

The nozzle F as best seen in FIG. 3 includes an internally threaded first end 68, with the nozzle having a first interior transverse surface 72. The threaded first end 68 of the nozzle body 74 engages threads 58 on the second end portion of the second right angle tube 50 as shown in FIG. 3.

The body 74 of nozzle F has a number of circumferentially spaced longitudinally extending passages 76 formed therein, with each passage including two oppositely tapered sections 76*a* and 76*b* as shown in FIG. 3. A cylindrical collar 80 is secured to a recessed portion 70*a* in the side wall 70, as may be seen in FIGS. 3 and 5, with the collar supporting a transverse shaft 82 on which a release pin 78 is pivotally supported. The collar 80 may be secured to the recessed portion 70*a* of side wall surface 70 by conventional means, such as a press fit or the like. A trigger 84 is provided that includes an outwardly extending angularly disposed tab 84*a*, with the trigger being bonded to a body 86 of wax or a low melting point alloy. The low melting point body 86 is supported in a recess 74*a* formed in the body 74 as shown in both FIGS. 3 and 5. The trigger 84 includes an aperture 84*b* through which the free end portion of the trigger 84 extends. The pin 78 when in the position shown in FIG. 3 and in engagement with aperture 84*b* serves to hold valve stem 64 in the position shown in FIG. 3 in which the head 62 is in sealing engagement with the tapered seat 56.

Upon a fire starting in the receptacle E, the temperature of the ambient atmosphere surrounding the receptacle rises and softens the body 86, with the trigger 84 then being forced away from body 86 due to the pressure exerted on the valve member 64 by pressurized fluid within the bore 50*a*. The pin 78 then pivots from the first position shown in FIG. 3 to the second position shown in FIG. 5, allowing the valve stem 64 to move downwardly for the head 62 to contact the transverse surface 72. Pressurized fluid now discharges at high velocity through the passages 76, and due to the tapered configuration of the sections 76*a* and 76*b* an audible noise is emitted by the flow of the pressurized fluid therethrough. The passages 76 serve to transform the pressurized fluid (not shown) into a number of sprays that are directed into the receptacle E to extinguish a fire that may have originated therein. The flow of pressurized fluid through the nozzle F is indicated by arrows 89 as may be seen in FIG. 5.

A safety ring 90 is shown in FIG. 6 that includes a slot 92 that has a circumferentially extending protuberance 94 projecting outwardly therefrom. When the fire extinguisher A is being shipped, the safety ring 90 may be mounted on the external surface of the nozzle F, for the tab 84*a* to be engaged by the protuberance 94. The ring is rotatably mounted on the nozzle F, and when the invention is placed in use, the ring is rotated to a position where the protuberance 94 is out of longitudinal alignment with the trigger 84. The bracket C as may be seen in FIGS. 1 and 2 includes a vertically extending member 96 that is secured to the wall D by screws 98. The member 96 has a vertically extending arcuate forward surface 96*a*. Two longitudinally spaced bands 100 extend forwardly from the member 96, and serve to rotatably and adjustably support the cylindrical container B therein when the container rests on a stop 102 that extends forwardly from member 96 as shown in FIG. 1. The container B when supported on the bracket C can be pivoted in a horizontal direction through substantially 180°. The nozzle F, due to the manner in which it is supported, may be adjusted to any desired angular position by rotating the second right angle tube 50 relative to the first tube 26.

The fire extinguishing fluid as it discharges through the first passage sections 76*a* has the velocity thereof increased with the fire extinguishing fluid as it enters the second section 76*b* expanding and slowing in velocity. This expansion and change in velocities results in an audible sound being emitted that serves as an alarm that a fire has occured.

The invention has been described in the specification and illustrated in the drawings as protecting a building from fire that originates in a trash receptacle E. However, the invention is not restricted to such use, but may be used to extinguish a fire that originates in a selected area irrespective of whether or not a trash receptacle is present in such area.

The use and operation of the invention has been explained previously and need not be repeated.

I claim:

1. A combined fire extinguisher and audible alarm capable of being adjustably supported from a wall to protect a desired area adjacent said wall:

a. a cylindrical container for a pressurized fire extinguishing fluid, said container including a top that supports an apertured normally closed valve;

b. a bracket that supports said container from said wall;

c. a first right angle tube that has first and second end portions;

d. first means for removably securing said first end portion to said top in communication with said valve;

e. second means for maintaining said valve in an open position when said first end portion is secured to said top;

f. a nozzle having a plurality of passages therein of such configuration that an audible noise is emitted therefrom as pressurized fluid flows therethrough;

g. third means for adjustably supporting said nozzle from said second end portion;

h. a valve member movably supported in said nozzle, said valve member capable of occupying either a first or second position, said valve member when in said first position preventing flow of said pressurized fire extinguishing fluid through said passages; and i. heat sensitive means that maintain said valve member in said first position until the temperature of the ambient atmosphere around said combined fire extinguisher and audible alarm rises above a predetermined maximum as a result of a fire in said area whereupon said heat sensitive means allows said pressurized fluid to move said valve member to said second position in which said pressurized fire extinguishing fluid discharges through said passages with emission of an audible noise to be transformed into a spray to extinguish said fire.

2. A combined fire extinguisher and audible alarm as defined in claim 1 in which said first right angle tube has external threads on said second end portion thereof and said third means includes:

j. a second right angle tube having a first end portion and a second end portion that is connected to said nozzle;

k. an externally threaded rotatable tube that has a first end portion connected to said first end portion of said second right angle tube and a second shouldered end portion that extends into said second end portion of said first right angle tube;

l. a resilient O-ring mounted on said shouldered end portion;

m. a housing nut that engages said threaded second end portion of said first right angle tube and cooperates with said shouldered end portion to deform said O-ring into rotatable sealing engagement with the interior surface of said first right angle tube; and n. a lock nut that engages said externally threaded rotatable tube and is in abutting contact with said housing nut.

3. A combined fire extinguisher and audible alarm as defined in claim 2 in which said second end portion of said second right angle tube has a tapered valve seat defined therein, and said valve member includes:

o. a tapered valve head that sealingly engages said valve seat when said valve member is in said first position; and p. a stem connected to said valve head, said stem slidably supported in said nozzle.

4. A combined fire extinguisher and audible alarm as defined in claim 3 in which said heat sensitive means includes:

q. a pin pivotally supported on said nozzle that engages the free end of said stem when said valve member is in said first position;

r. a trigger having an aperture therein that is engaged by said pin when said valve member is in said first position;

s. a body of low melting point material that bonds said trigger to said nozzle until a predetermined maximum temperature is reached whereupon said trigger is released, with said pin upon said release pivoting to a second position to allow said valve member to move to a second position.

* * * * *